US007724227B2

(12) United States Patent
Yang et al.

(10) Patent No.: US 7,724,227 B2
(45) Date of Patent: May 25, 2010

(54) SIGNAL COMPENSATION FOR FLAT PANEL DISPLAY

(75) Inventors: Ying-Wen Yang, Yongkang (TW); Yung-Li Huang, Tainan (TW)

(73) Assignee: Chi Mei Optoelectronics Corporation, Tainan (TW)

( * ) Notice: Subject to any disclaimer, the term of this patent is extended or adjusted under 35 U.S.C. 154(b) by 823 days.

(21) Appl. No.: 11/645,218

(22) Filed: Dec. 22, 2006

(65) Prior Publication Data

US 2007/0159441 A1 Jul. 12, 2007

(30) Foreign Application Priority Data

Dec. 23, 2005 (TW) ..... 94146140 A

(51) Int. Cl.
*G09G 3/36* (2006.01)

(52) U.S. Cl. ..... 345/95; 345/204

(58) Field of Classification Search ... 315/169.1–169.4; 345/87–102, 204, 208–212
See application file for complete search history.

(56) References Cited

U.S. PATENT DOCUMENTS

| | | | | |
|---|---|---|---|---|
| 5,894,293 | A * | 4/1999 | Hush et al. | 345/74.1 |
| 6,249,087 | B1 * | 6/2001 | Takayama et al. | 315/169.1 |
| 7,352,350 | B2 * | 4/2008 | Nitta et al. | 345/94 |
| 2001/0045930 | A1 * | 11/2001 | Miyajima et al. | 345/92 |
| 2005/0104816 | A1 * | 5/2005 | Kimura et al. | 345/76 |
| 2005/0253826 | A1 * | 11/2005 | Yang | 345/204 |
| 2006/0066594 | A1 * | 3/2006 | Tyger | 345/204 |
| 2006/0139302 | A1 * | 6/2006 | Chen et al. | 345/102 |
| 2006/0176261 | A1 * | 8/2006 | Nitta et al. | 345/94 |
| 2006/0187176 | A1 * | 8/2006 | Yang | 345/100 |
| 2006/0284815 | A1 * | 12/2006 | Kwon et al. | 345/98 |
| 2007/0139341 | A1 * | 6/2007 | Kubo et al. | 345/98 |
| 2007/0188432 | A1 * | 8/2007 | Kwon et al. | 345/92 |
| 2007/0279360 | A1 * | 12/2007 | Park et al. | 345/94 |

FOREIGN PATENT DOCUMENTS

| | | |
|---|---|---|
| TW | 588183 | 5/2004 |
| TW | 1231463 | 4/2005 |
| TW | 1242666 | 11/2005 |

OTHER PUBLICATIONS

Office Action dated Feb. 27, 2009 for TW Application No. 94146140.
Kim, S. H. et al, "P-16: A New Driving Method to Compensate for Row Line Signal Propagation Delays in an AMLCD" *SID 04 DIGEST*, pp. 280-283, 2004.

* cited by examiner

*Primary Examiner*—Nitin Patel
(74) *Attorney, Agent, or Firm*—Fish & Richardson P.C.

(57) ABSTRACT

A flat panel display includes a plurality of pixel circuits, each pixel circuit including a switch and a storage capacitor, in which the storage capacitor receives pixel data from a data line when the switch is turned on. A scan driver controls the switches of the pixel circuits, in which the scan driver turns on a first switch of a first pixel circuit for a first length of time within a frame period, and turns on a second switch of a second pixel circuit for a second length of time within the frame period, the first length of time being different from the second length of time.

33 Claims, 6 Drawing Sheets

SIGNAL COMPENSATION FOR FLAT PANEL DISPLAY

CROSS REFERENCE TO RELATED APPLICATIONS

The application claims priority to Taiwan Application No. 94146140, filed Dec. 23, 2005, the contents of which are incorporated by reference.

BACKGROUND

The description relates to signal compensation for flat panel displays.

Referring to FIG. 1, an example of a liquid crystal display 100 includes an array of rows and columns of pixel circuits 13, each pixel circuit 13 corresponding to a scan line (e.g., 20*a*, 20*b*, 20*c*, or 20*m*) and a data line (e.g., 16*a*, 16*b*, or 16*n*). The scan lines (collectively referenced as 20) are driven by a scan driver 22, and the data lines (collectively referenced as 16) are driven by a data driver 10. Each pixel circuit 13 includes a transistor (e.g., 12*ba*, 12*bn*, or 12*ca*) and a storage capacitor (e.g., 14*ba*, 14*bn*, or 14*ca*). A timing controller 24 controls the scan driver 22 to send scan signals on the scan lines 20 to successively turn on the transistors 12 of each row, allowing the data driver 10 to send pixel data through the data lines 16 to corresponding storage capacitors 14. For example, the gate electrode of the transistor 12*ba* is connected to the scan line 20*b*. The transistor 12*ba* functions as a switch positioned between the storage capacitor 14*ba* and the data line 16*a*. When the transistor 12*ba* is turned on (e.g., by sending a logic high scan signal on the scan line 20*b*), the storage capacitor 14*ba* is connected to the data line 16*a* and is charged to the voltage level on the data line 16*a*. The pixel data stored in the storage capacitors 14 correspond to gray levels of pixels of an image shown on the display 100.

SUMMARY

In one aspect, in general, a display includes a plurality of pixel circuits, each pixel circuit including a switch and a storage capacitor, in which the storage capacitor receives pixel data from a data line when the switch is turned on. A scan driver controls the switches of the pixel circuits, in which the scan driver turns on a first switch of a first pixel circuit for a first length of time within a frame period, and turns on a second switch of a second pixel circuit for a second length of time within the frame period, the first length of time being different from the second length of time.

Implementations of the display can include one or more of the following features. The difference in the first and second time periods is selected to compensate a difference in pixel data voltage levels received at the storage capacitors of the first and second pixel circuits due to a difference in positions of the pixel circuits relative to a data driver that drives the data line.

The pixel data are generated by a host device, and the difference in the first and second time periods is selected to cause the first pixel circuit to have a same luminance as that of the second pixel circuit when the pixel data for the first and second pixel circuits are intended by the host device to represent the same luminance. The plurality of pixel circuits include rows of pixel circuits, and the scan driver turns on switches of pixel circuits of a first row for the first length of time, and turns on switches of pixel circuits of a second row for the second length of time. The first row is closer to a data driver that drives the data line than the second row, and the first length of time is shorter than the second length of time.

The plurality of pixel circuits include N groups of pixel circuits, in which the scan driver turns on switches of pixel circuits of a first group for a length of time T, and turns on switches of pixel circuits of an i-th group for a length of time $T+(i-1)*\Delta t$, $1 \leqq i \leqq N$. Each group of pixel circuits includes at least two rows of pixel circuits. The parameter $\Delta t$ is an integer multiple of, e.g., a half cycle of a clock signal. The plurality of pixel circuits include rows of pixel circuits, and the length of time for which the switches of a particular row is turned on is a function of the row number. The function includes a linear function of the row number. The display includes a timing controller for determining the first and second lengths of time based on an initial length of time and an incremental length of time. The timing controller determines the first and second lengths of time also based on row numbers where the first and second pixel circuits are located. The switch includes a transistor, and the scan driver controls a voltage applied to a gate electrode of the transistor to control the duration that the transistor is turned on. Each pixel circuit includes a liquid crystal cell.

In another aspect, in general, a display includes data lines, a data driver for driving the data lines, and a plurality of pixel circuits, each pixel circuit including a transistor and a storage capacitor, in which the storage capacitor receives pixel data from one of the data lines when the transistor is turned on. A scan driver controls the transistors, in which the scan driver turns on transistors of a first row of pixel circuits for a first length of time, and turns on transistors of a second row of pixel circuits for a second length of time that is different from the first length of time. A timing controller controls the first length of time and the second length of time.

Implementations of the display can include one or more of the following features. The difference in the first and second lengths of time is selected to compensate differences in pixel data voltage levels received at the storage capacitors of the first and second rows of pixel circuits due to differences in positions of the pixel circuits relative to the data driver. The pixel data are generated by a host device, and the difference in the first and second lengths of time is selected to cause the first row of pixel circuits to have a same luminance as that of the second row of pixel circuits when the pixel data for the first and second row of pixel circuits are intended by the host device to represent the same luminance. The first row is closer to the data driver than the second row, and the first length of time is shorter than the second length of time. The length of time for which the switches of a particular row is turned on is a function of the row number. The function includes a linear function of the row number.

In another aspect, in general, a method includes turning on a first switch of a first pixel circuit of a display for a first length of time, and charging a storage capacitor of the first pixel circuit with pixel data during the first length of time. A second switch of a second pixel circuit of the display is turned on for a second length of time, and a storage capacitor of the second pixel circuit is charged with pixel data during the second length of time, the first length of time being different from the second length of time.

Implementations of the method can include one or more of the following features. The difference in the first and second time periods is selected to compensate a difference in pixel data voltage levels received at the storage capacitors of the first and second pixel circuits due to a difference in positions of the pixel circuits relative to a data driver that sends the pixel data. The pixel data are generated by a host device, and the difference in the first and second time periods is selected to cause the first pixel circuit to have a same luminance as that of the second pixel circuit when the pixel data for the first and second pixel circuits are intended to represent the same luminance. The method includes turning on switches in a first row of pixel circuits for the first length of time, and turning on switches in a second row of pixel circuits for the second length of time, the first row including the first pixel circuit, the second row including the second pixel circuit. The first row is closer to a data driver that provides the pixel data to the storage capacitors, and the first length of time is shorter than the second length of time.

The method includes turning on switches of successive groups of pixel circuits for increasing lengths of time, the switches of an i-th group of pixel circuits being turned on for a length of time shorter than that for the switches of an (i+1)-th group of pixel circuits, $1 \leqq i \leqq N$, in which N is an integer. The method includes turning on switches of pixel circuits of the first group for a duration T, and turning on switches of pixel circuits of the i-th group for a duration $T+(i-1)*\Delta t$. In some examples, each group of pixel circuits includes one row of pixel circuits. In some examples, each group of pixel circuits includes at least two rows of pixel circuits. The method includes turning on the switches of a particular row of pixel circuits based on a function of the row number. The function includes a linear function of the row number. The method includes determining the first and second lengths of time based on an initial length of time and an increment time width.

Advantages of the displays and methods may include one or more of the following. By compensating the distortion to data signals caused by the RC effects of the data lines, the luminance of images shown on the display can be more accurate. For large size display panels, the differences in pixel data voltage levels received at different pixel circuits caused by differences in distances from a data driver can be reduced.

DETAILED DESCRIPTION

Figure 1:
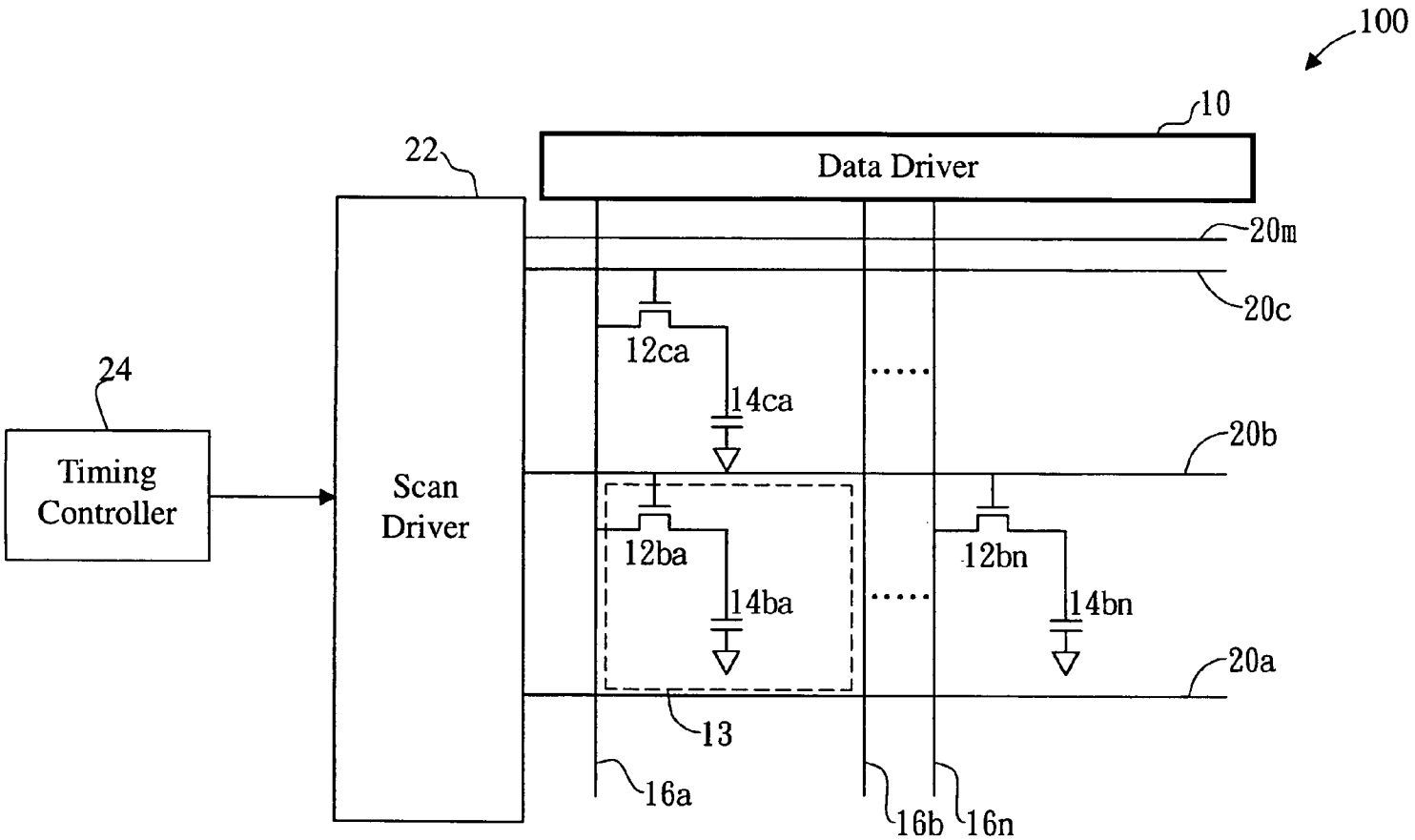
FIG. 1 is a schematic diagram of an LCD panel.
Figure 2:
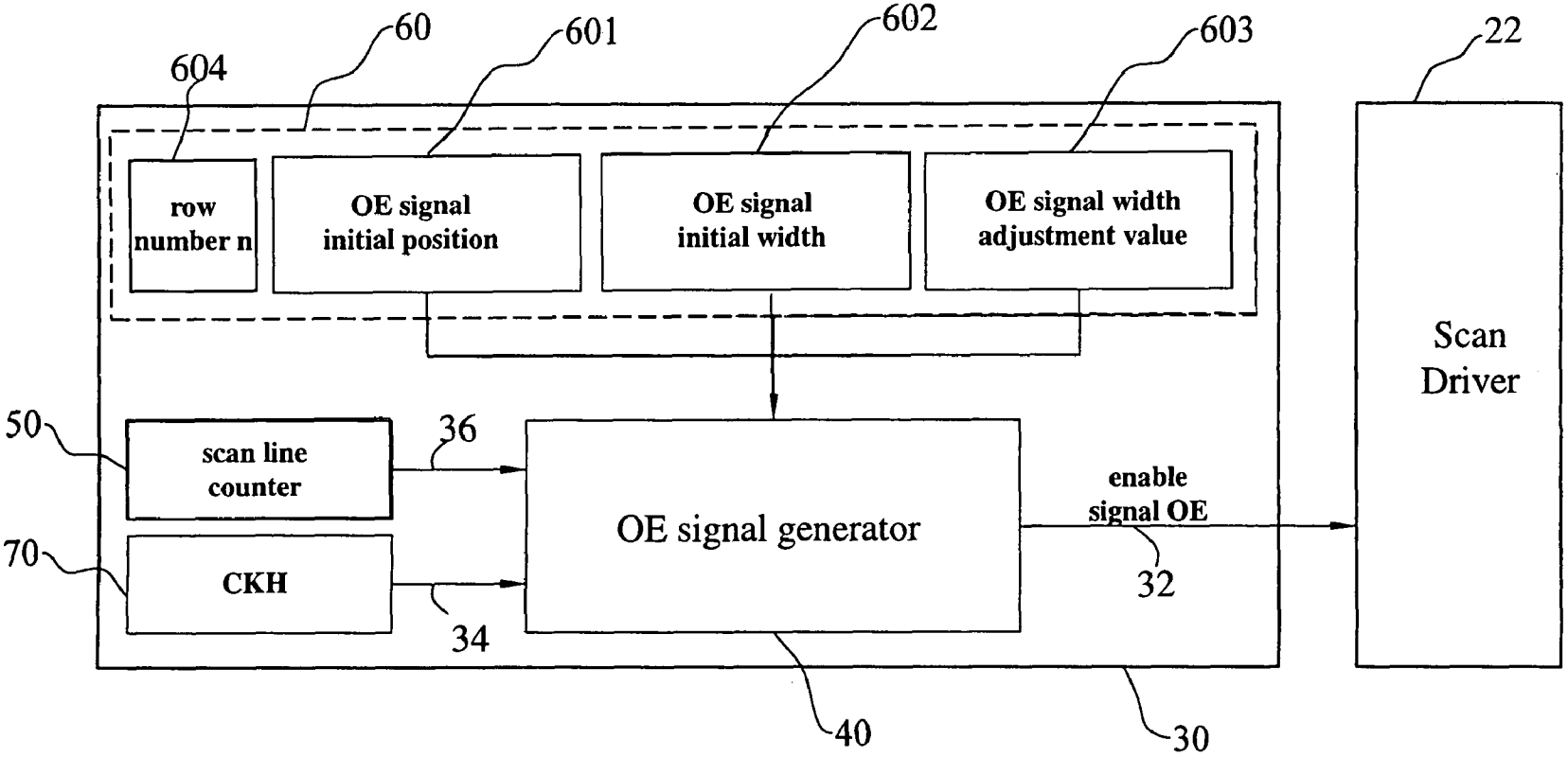
FIG. 2 is a schematic diagram of a timing controller.

FIG. 2 is a block diagram of an example of a timing controller 30 that reduces distortions in pixel data sent from the data driver 10 (FIG. 1) to the pixel circuits 13 through the data lines 16. The distortions can be caused by, e.g., RC effects of the data lines 16. When the data driver 10 drives the storage capacitors 14 through the data lines 16, the resistances and capacitances of the data lines 16 affect the signals propagating on the data lines 16. It may take a longer time to charge the storage capacitor 14 of a pixel circuit 13 located farther from the data driver 10 to a specified voltage level than to charge the storage capacitor 14 of another pixel circuit 13 located closer to the data driver 10. For an image having a uniform luminance, if all of the storage capacitors 14 were charged for the same amount of time, the pixel data stored in the storage capacitors 14 of different pixel circuits 13 may have voltage levels that depend on the positions of the pixel circuits 13 relative to the data driver 10, e.g., the farther away from the data driver 10 the lower the voltage level. This may cause distortion in the luminance of images shown on the display 100.

The timing controller 30 compensates the distortions in pixel data voltage levels received at different pixel circuits 13 by turning on the transistors 12 of different pixel circuits 13 for different lengths of time. The length of time that a transistor is turned on will be referred to as the "turn-on time width". For example, the transistor 12*ba* is farther away from the data driver 10 than the transistor 12*ca*, so the transistor 12*ba* may be turned on for a longer period of time than the transistor 12*ca*. The longer charging time compensates for the RC effect of the data line 16*a*, resulting in images having more accurate luminance.

The timing controller 30 includes an operation enable (OE) signal generator 40 that generates an enable signal OE 32 for controlling the scan driver 22. In this example, the scan driver 22 is logic low enabled so that when the enable signal OE 32 is at a logic low level, the scan driver 22 outputs a logic high signal to turn on the transistors 12. A horizontal timing (CKH) signal generator 70 provides a CKH signal 34, which can be used to determine an incremental time value Δt between the turn-on time widths of different rows of pixel circuits.

A scan line counter 50 provides a count number indicating which scan line 20 is currently being driven by the scan driver 22. In this example, the data driver 10 is located near the top of the display 100, and an i-th row is located closer to the data driver 10 than an (i+1)-th row. A memory 60 stores parameter values, such as an enable signal initial position 601, an enable signal initial width 602, an enable signal width adjustment value 603, and a row number n 604.

In some examples, the data lines 16 are first charged to certain data voltage levels according to pixel data, then the scan signal turns on the transistors 12 to allow the pixel data to be written into the storage capacitors 14. In some examples, the enable signal initial position 601 represents a position of a rising edge of the scan signal relative to the rising edge of the data signal on the data line 16. In some examples, the enable signal initial position 601 represents a position of the rising edge of the enable signal OE 32.

The enable signal width adjustment value 603 is used to determine the amount in which the turn-on time widths are modified. The row number n 604 represents the number of rows that have the same turn-on time width, so that the turn-on time width is incremented every n rows, $1 \leqq n$. The value n is selected based on the granularity in which the turn-on time width is adjusted. For example, n can be larger if coarse adjustment to the turn-on time widths is used, and n can be smaller if fine adjustment to the turn-on time widths is used. For example, if n=10, the turn-on time width of the transistors 12 is incremented every 10 rows, and if n=100, the turn-on time width of the transistors 12 are incremented every 100 rows.

An initial turn-on time width for the first row of pixel circuits 13 is equal to the enable signal initial width 601 times the half-period of the CKH signal 34. The incremental time value Δt is equal to the enable signal width adjustment value 603 times the half-period of the CKH signal 34. For example, if the enable signal initial width 602 equals 1000, the enable signal width adjustment value 603 equals 30, and a half-period of the CKH signal is 30 μs, then the initial turn-on time is 1000×30 μs=30 ms, and the incremental time value is 30×30 μs=900 μs. If the row number n 604 is equal to 10, then the turn-on time width for transistors 12 in rows 1 to 10 is 30 ms, the turn-on time width for transistors 12 in rows 20 to 30 is 30.9 ms, and so forth.

The timing controller 30 obtains the parameter setting values 601 to 604 from the memory 60, and generates the enable signal OE 32 according to the enable signal initial position 601, the enable signal initial width 602, the enable signal width adjusting value 603, the row number n 604, and the horizontal timing signal (CKH) 34. The CKH signal 34 functions as a clock signal for synchronizing the rising and falling edges of the enable signal 32. The turn-on time width of the scan signal for each scan line 20 is determined according to the enable signal OE 32. Thus, the turn-on time width of the scan signal can be adjusted by changing the pulse width of the enable signal OE 32. When the enable signal OE 32 is adjusted, the enable signal initial position 601 is increased while the enable signal initial width 602 is decreased so that the turn-on time widths of the scan signals of the LCD panel is adjusted. This results in more accurate luminance of images across the display 100. When a host device (e.g., a computer) sends an image signal representing an image that has a uniform luminance, the image shown on the display 100 can be more accurate, i.e., has a uniform luminance.

By comparison, without compensating the distortion of the pixel data due to the RC effects of the data lines 16, when the host device sends an image signal representing an image that has a uniform luminance, the image actually shown on the display 100 may have a luminance that varies depending on the positions of the pixels relative to the data driver (e.g., the luminance may vary along a vertical direction).

Figure 3:
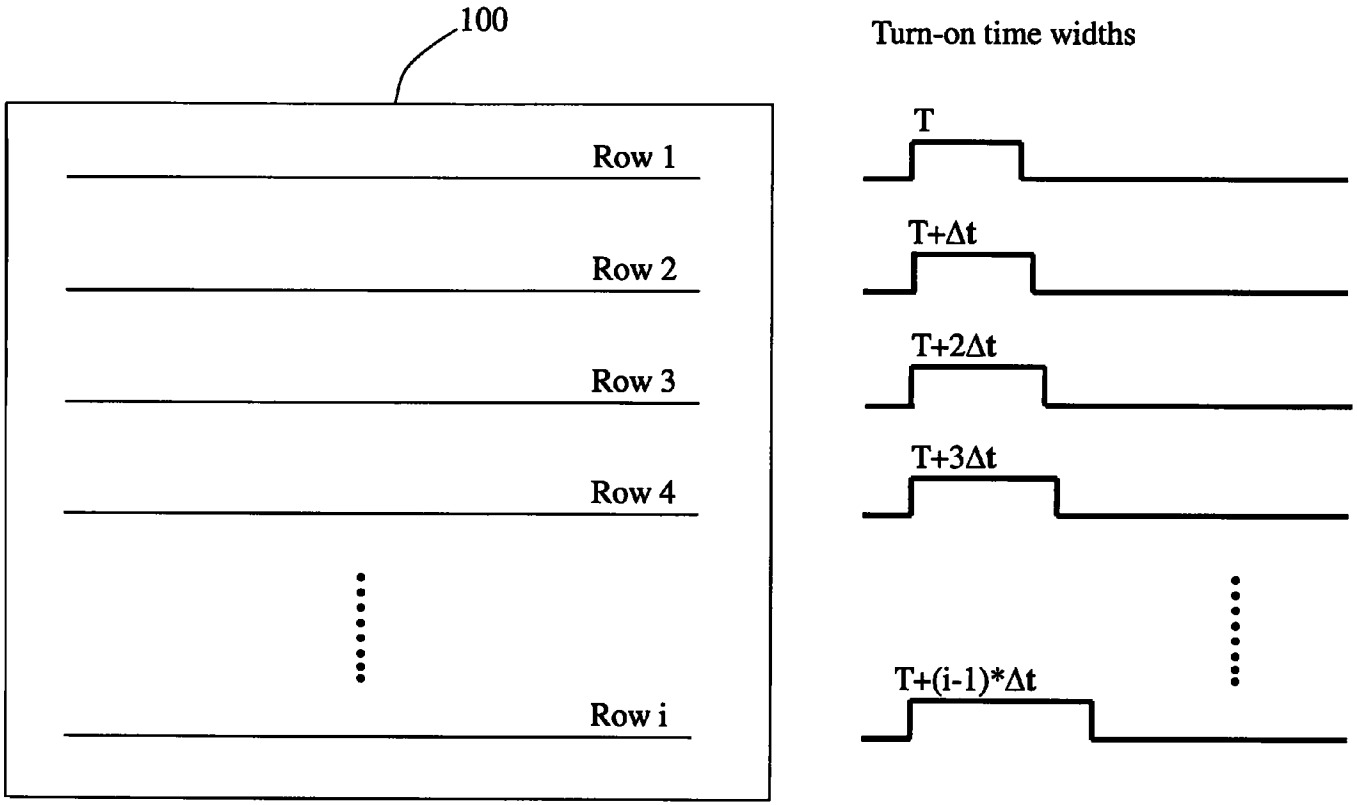
FIGS. 3 and 4 are diagrams showing relationships between row numbers and turn-on time widths.

FIG. 3 shows an example in which the timing controller 30 increments the turn-on time widths for each row by an amount Δt. The right portion of the figure shows the turn-on time widths of transistors in corresponding rows at the left portion of the figure. For example, the transistors 12 of row 1 have a turn-on time width equal to T, the transistors 12 of row 2 have a turn-on time width equal to T+Δt, and the transistors 12 of the i-th row have a turn-on time width equal to T+(i−1)*Δt, and so forth.

Figure 4:
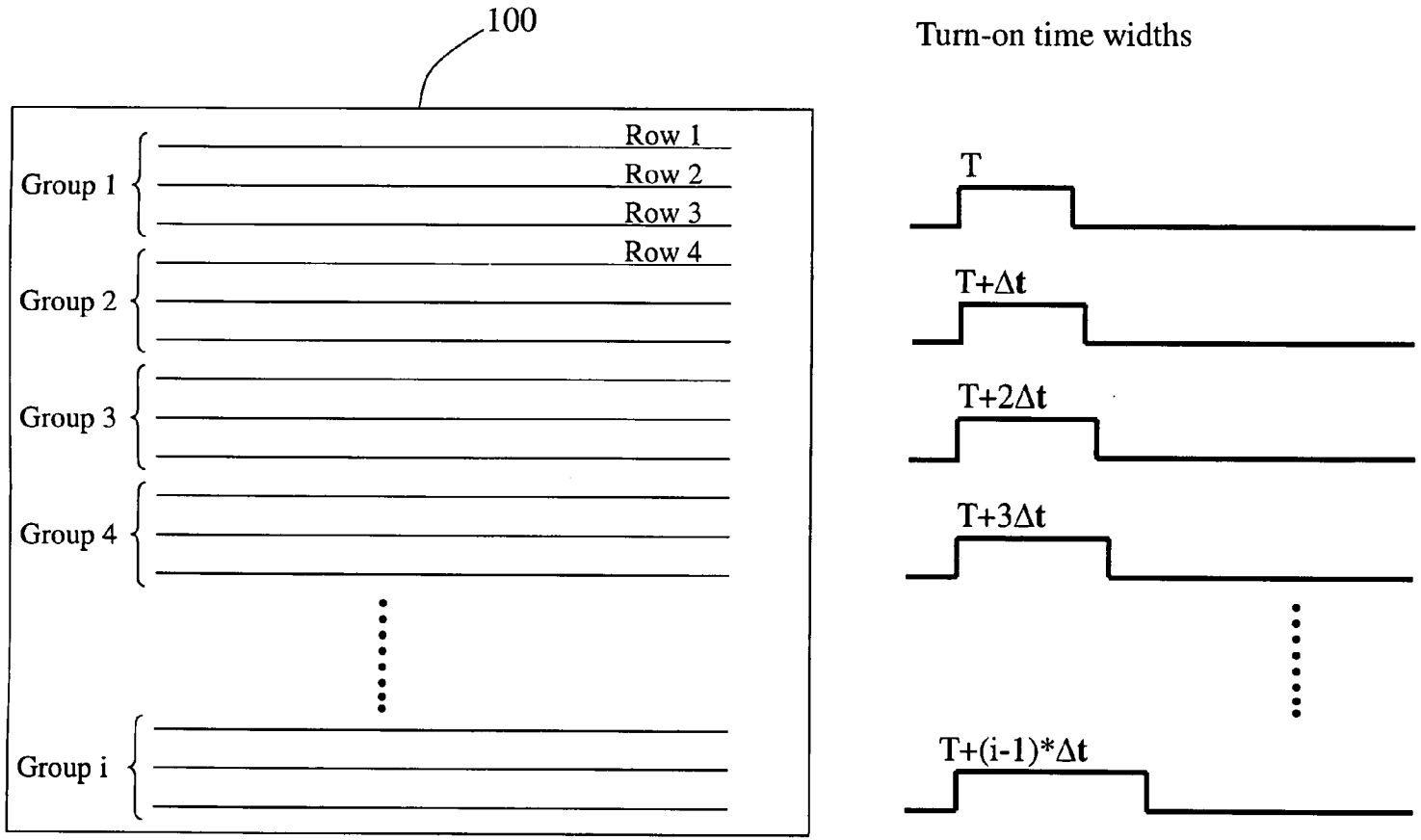

FIG. 4 shows an example in which the timing controller 30 increments the turn-on time widths every 3 rows by an amount Δt. The rows of the display 100 are divided into groups, e.g., groups 1 to i. The right portion of the figure shows the turn-on time widths of transistors in corresponding groups shown in the left portion of the figure. For example, the transistors 12 of group 1 (which includes rows 1 to 3) have a turn-on time width equal to T, the transistors 12 of group 2 (which includes rows 4 to 6) have a turn-on time width equal to T+Δt, and the transistors 12 of the i-th group has a turn-on time width equal to T+(i−1)*Δt, and so forth.

In the examples shown in FIGS. 3 and 4, the turn-on time widths of transistors of different rows is a linear function of the row number. In some examples, the turn-on time widths can be a non-linear function of the row number.

Figure 5:
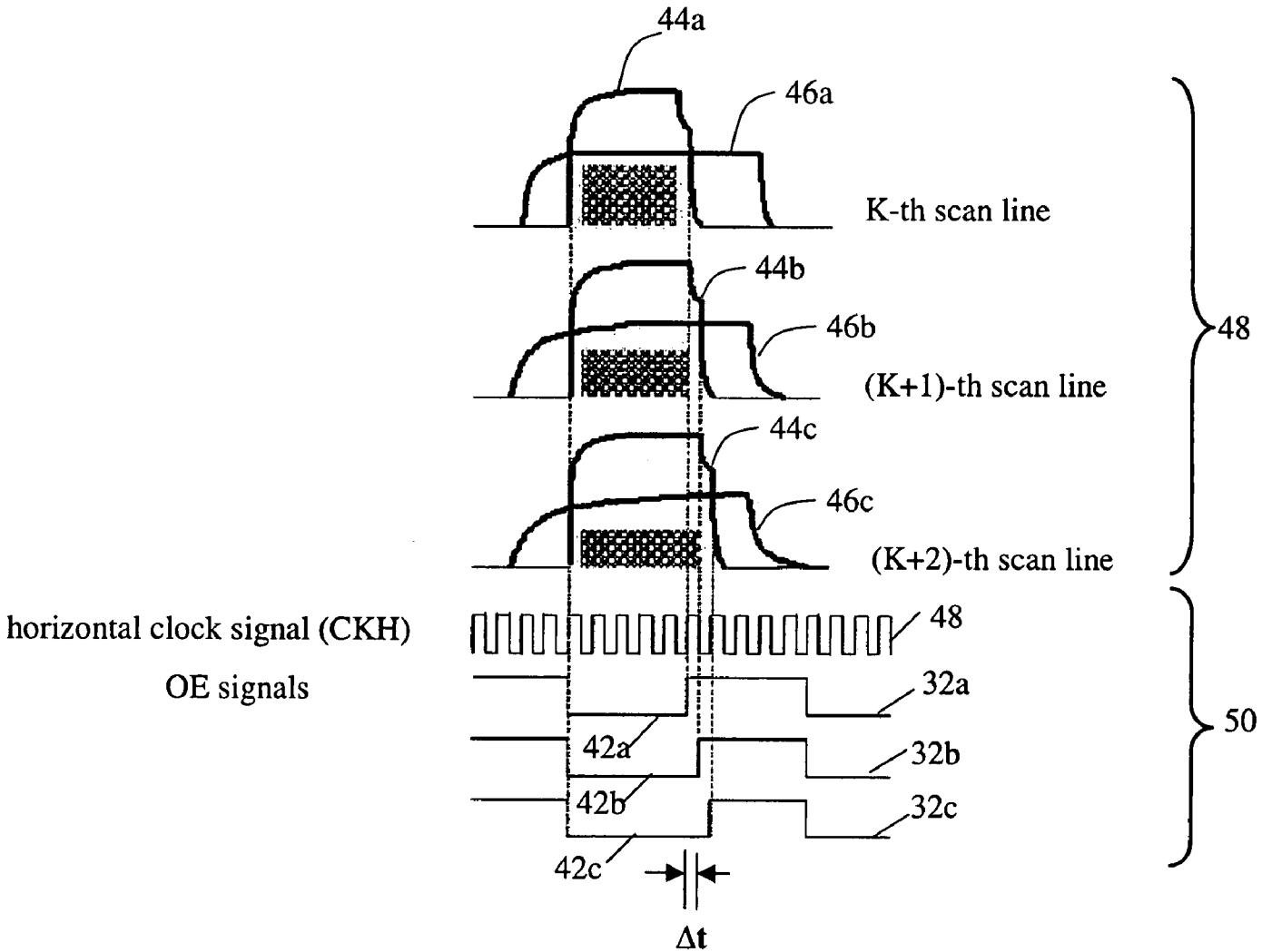
FIGS. 5 and 6 are graphs.

FIG. 5 is a graph showing a relationship between the time widths of the enable (OE) signal 32 and the time widths of the scan signals. An upper portion 48 of the figure shows the waveforms of scan signals 44*a*, 44*b*, and 44*c*, and pixel data voltage levels 46*a*, 46*b*, and 46*c* on data lines 16 received at pixel circuits that correspond to the K-th, (K+1)-th, and (K+2)-th scan lines 20, respectively.

When the scan signals 44*a*, 44*b*, and 44*c* are high, the transistors 12 of the K-th, (K+1)-th, and (K+2)-th rows 20 are turned on, respectively. The length of time in which the scan signal 44*b* is at logic high is longer than that of scan signal 44*a* by approximately Δt. Similarly, the length of time in which the scan signal 44*c* is at logic high is longer than that of scan signal 44*b* by approximately Δt. The transistors 12 of the (K+1)-th row is charged for a length of time that is longer than that of the transistors 12 of the K-th row by approximately Δt. Similarly, the transistors 12 of the (K+2)-th row is charged for a length of time that is longer than that of the transistors 12 of the (K+1)-th row by approximately Δt.

A lower portion 50 of the figure shows waveforms of corresponding CKH signal and enable signals 32*a*, 32*b*, and 32*c*. The enable signal 32*b* has a logic low portion 42*b* that is longer than that of the enable signal 32*a* by approximately Δt. The enable signal 32*c* has a logic low portion 42*c* that is longer than that of the enable signal 32*b* by approximately Δt. The scan driver 22 is low enabled, so a longer logic low portion 42 results in a scan signal having a longer logic high portion, which in turn causes the transistors 12 to be turned on for a longer period of time.

Figure 6:
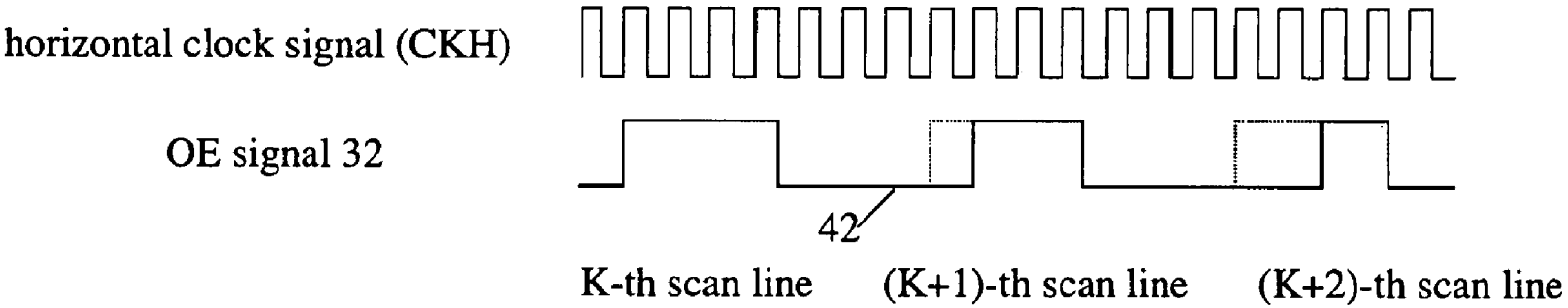

FIG. 6 is a graph of the CKH signal 34 and the enable signal 32, in which the width of the logic low portion 42 of the enable signal 32 increases linearly as the row number increases. When the scan driver 22 sequentially scans the scan lines 20, the width of the logic low portion of the enable signal OE 32 gradually increased linearly so that the turn-on time width of the scan signal increased linearly. The increase in the turn-on time width compensates the distortion in the pixel data due to the RC effects of the data lines. This can be useful for large size displays, in which the data lines are long and the RC effects of the data lines can be significant.

Different displays may use different compensation schemes by changing the values of the enable signal initial position 601, the enable signal initial width 602, the enable signal width adjustment value 603, and the row number n 604.

A number of embodiments of the invention have been described. Nevertheless, it will be understood that various modifications may be made without departing from the spirit and scope of the invention. For example, the data driver 10 can be positioned near a lower edge of the active display area. Dual data drivers can be used, in which a data driver is positioned near the upper edge of the active display area, and another data driver is positioned near the lower edge of the active display area. In some examples, the data drivers can be positioned at the left and/or right edges of the active display area, and the scan drivers can be positioned at the upper and/or lower edges of the active display area. The scan driver can be high enabled instead of low enabled. The values of the enable signal initial position 601, the enable signal initial width 602, the enable signal width adjustment value 603, and the row number n 604 can be different from those described above. The initial turn-on time width for the first row of pixel circuits 13 can be equal to the enable signal initial width 601 times the period of the CKH signal 34, and the incremental time value Δt can be equal to the enable signal width adjustment value 603 times the period of the CKH signal 34. The formulas for determining the initial turn-on time width and the incremental time value Δt can be different from those described above.

The display 100 is not limited to liquid crystal displays. The signal compensation scheme described above can be used in other types of displays that use storage capacitors to store pixel data, in which the storage capacitors are driven by data drivers through data lines.

Accordingly, other implementations are within the scope of the following claims.

What is claimed is:

1. A display comprising:

a plurality of pixel circuits, each pixel circuit comprising a switch and a storage capacitor, the storage capacitor to receive pixel data from a data line when the switch is turned on; and a scan driver for controlling the switches of the pixel circuits, in which the scan driver turns on a first switch of a first pixel circuit for a first length of time within a frame period, and turns on a second switch of a second pixel circuit for a second length of time within the frame period, the first length of time being different from the second length of time.

2. The display of claim 1 wherein the difference in the first and second time periods is selected to compensate a difference in pixel data voltage levels received at the storage capacitors of the first and second pixel circuits due to a difference in positions of the pixel circuits relative to a data driver that drives the data line.

3. The display of claim 1 wherein the pixel data are generated by a host device, and the difference in the first and second time periods is selected to cause the first pixel circuit to have a same luminance as that of the second pixel circuit when the pixel data for the first and second pixel circuits are intended by the host device to represent the same luminance.

4. The display of claim 1 wherein the plurality of pixel circuits comprise rows of pixel circuits, and the scan driver turns on switches of pixel circuits of a first row for the first length of time, and turns on switches of pixel circuits of a second row for the second length of time.

5. The display of claim 4 wherein the first row is closer to a data driver that drives the data line than the second row, and the first length of time is shorter than the second length of time.

6. The display of claim 1 wherein the plurality of pixel circuits comprise N groups of pixel circuits, the scan driver turns on switches of pixel circuits of a first group for a length of time T, and turns on switches of pixel circuits of an i-th group for a length of time $T+(i-1)*\Delta t$, $1 \leqq i \leqq N$.

7. The display of claim 6 wherein each group of pixel circuits comprises at least two rows of pixel circuits.

8. The display of claim 6 wherein $\Delta t$ is an integer multiple of a half cycle of a clock signal.

9. The display of claim 1 wherein the plurality of pixel circuits comprise rows of pixel circuits, and the length of time for which the switches of a particular row is turned on is a function of the row number.

10. The display of claim 9 wherein the function comprises a linear function of the row number.

11. The display of claim 1, further comprising a timing controller for determining the first and second lengths of time based on an initial length of time and an incremental length of time.

12. The display of claim 11 wherein the timing controller determines the first and second lengths of time also based on row numbers where the first and second pixel circuits are located.

13. The display of claim 1 wherein the switch comprises a transistor, and the scan driver controls a voltage applied to a gate electrode of the transistor to control the duration that the transistor is turned on.

14. The display of claim 1 wherein each pixel circuit comprises a liquid crystal cell.

15. A display comprising:

data lines;

a data driver for driving the data lines;

a plurality of pixel circuits, each pixel circuit comprising a transistor and a storage capacitor, the storage capacitor to receive pixel data from one of the data lines when the transistor is turned on;

a scan driver for controlling the transistors, in which the scan driver turns on transistors of a first row of pixel circuits for a first length of time, and turns on transistors of a second row of pixel circuits for a second length of time that is different from the first length of time; and a timing controller for controlling the first length of time and the second length of time.

16. The display of claim 15 wherein the difference in the first and second lengths of time is selected to compensate differences in pixel data voltage levels received at the storage capacitors of the first and second rows of pixel circuits due to differences in positions of the pixel circuits relative to the data driver.

17. The display of claim 15 wherein the pixel data are generated by a host device, and the difference in the first and second lengths of time is selected to cause the first row of pixel circuits to have a same luminance as that of the second row of pixel circuits when the pixel data for the first and second row of pixel circuits are intended by the host device to represent the same luminance.

18. The display of claim 17 wherein the first row is closer to the data driver than the second row, and the first length of time is shorter than the second length of time.

19. The display of claim 15 wherein the length of time for which the switches of a particular row is turned on is a function of the row number.

20. The display of claim 19 wherein the function comprises a linear function of the row number.

21. A method comprising:

turning on a first switch of a first pixel circuit of a display for a first length of time, and charging a storage capacitor of the first pixel circuit with pixel data during the first length of time; and turning on a second switch of a second pixel circuit of the display for a second length of time, and charging a storage capacitor of the second pixel circuit with pixel data during the second length of time, the first length of time being different from the second length of time.

22. The method of claim 21 wherein the difference in the first and second time periods is selected to compensate a difference in pixel data voltage levels received at the storage capacitors of the first and second pixel circuits due to a difference in positions of the pixel circuits relative to a data driver that sends the pixel data.

23. The method of claim 21 wherein the pixel data are generated by a host device, and the difference in the first and second time periods is selected to cause the first pixel circuit to have a same luminance as that of the second pixel circuit when the pixel data for the first and second pixel circuits are intended to represent the same luminance.

24. The method of claim 21, further comprising turning on switches in a first row of pixel circuits for the first length of time, and turning on switches in a second row of pixel circuits for the second length of time, the first row including the first pixel circuit, the second row including the second pixel circuit.

25. The method of claim 24 wherein the first row is closer to a data driver that provides the pixel data to the storage capacitors, and the first length of time is shorter than the second length of time.

26. The method of claim 21, further comprising turning on switches of successive groups of pixel circuits for increasing lengths of time, the switches of an i-th group of pixel circuits being turned on for a length of time shorter than that for the switches of an (i+1)-th group of pixel circuits, $1 \leqq i \leqq N$, wherein N is an integer.

27. The method of claim 26 wherein each group of pixel circuits comprises a single row of pixel circuits.

28. The method of claim 26 wherein each group of pixel circuits comprises at least two rows of pixel circuits.

29. The method of claim 21, further comprising turning on switches of pixel circuits of the first group for a duration T, and turning on switches of pixel circuits of the i-th group for a duration $T+(i-1)*\Delta t$.

30. The method of claim 21, further comprising turning on the switches of a particular row of pixel circuits for a length of time based on a function of the row number.

31. The method of claim 30 wherein the function comprises a linear function of the row number.

32. The method of claim 21, further comprising determining the first and second lengths of time based on an initial length of time and an increment time width.

33. The method of claim 32, further comprising determining the first and second lengths of time based on row numbers where the pixel circuits are located.

* * * * *